United States Patent [19]

Boggs et al.

[11] Patent Number: 5,060,551

[45] Date of Patent: Oct. 29, 1991

[54] SOLUTION MONOPROPELLANT FOR LIQUID PROPELLANT GUN APPLICATION

[75] Inventors: Thomas L. Boggs; Jack L. Prentice; Donald E. Zurn, all of Ridgecrest, Calif.

[73] Assignee: The United States of America as represented by the Secretary of the Navy, Washington, D.C.

[21] Appl. No.: 785,971

[22] Filed: Apr. 4, 1977

[51] Int. Cl.[5] ..... F41A 1/04

[52] U.S. Cl. ..... 89/7

[58] Field of Search ..... 89/7,

[56] References Cited

U.S. PATENT DOCUMENTS

| | | | |
|---|---|---|---|
| 2,965,000 | 12/1960 | Skinner | 89/7 X |
| 3,024,595 | 3/1962 | Helvenston et al. | 149/76 X |
| 3,888,159 | 6/1975 | Elmore et al. | 89/7 |
| 3,969,979 | 7/1976 | Schneider et al. | 89/7 |
| 4,004,415 | 1/1977 | Wood | 89/7 X |
| 4,005,632 | 2/1977 | Holtrop | 89/7 |
| 4,050,348 | 9/1977 | Graham | 89/7 |

*Primary Examiner*—David H. Brown

*Attorney, Agent, or Firm*—Melvin J. Siliwka; Sol Sheinbein

[57] ABSTRACT

A method for firing a liquid propellant gun comprising the steps of injecting a liquid monopropellant made up of ammonia and ammonium perchlorate into a chamber behind the gun projectile and igniting the monopropellant.

3 Claims, No Drawings

SOLUTION MONOPROPELLANT FOR LIQUID PROPELLANT GUN APPLICATION

BACKGROUND OF THE INVENTION

1. Field of the Invention

This invention relates to a method for firing a liquid propellant gun. More particularly, this invention relates to a method for firing a liquid propellant gun wherein the propellant is a solution of ammonium perchlorate in ammonia.

2. Description of the Prior Art

Liquid propellant guns offer certain advantages over conventional guns. Among these advantages are the elimination of the inconvenience and weight of cartridges. Accordingly, considerable experimentation is presently being carried out in efforts to develop liquid propellant guns.

Several experimental liquid propellant guns are now in existence. Such a gun is fired by (1) inserting a projectile into the rear of the barrel, (2) injecting liquid propellant into a chamber behind the projectile and (3) igniting the propellant. The burning propellant produces expanding gases which drive the projectile out of the barrel.

In the past, propellants for liquid propellant guns have typically been bipropellants. For example, in the early experiments a mixture of nitric acid and n-octane was used. The mixture was actually prepared in the firing or combustion chamber. That is, nitric acid was injected into the firing chamber from one source and n-octane from another source whereby the two mixed in the chamber. The mixture was then ignited and burned. The combustion produced gases which drove the projectile from the barrel.

The use of a bipropellant, i.e., a propellant composition which is mixed in the firing chamber, presents a problem in that each component must be separately removed from its source, metered and delivered to the firing chamber through its own nozzle or port. Accordingly, experimentation with monopropellants was carried out because the use of a monopropellant would permit gun simplification.

Insofar as is known by the inventors, the first monopropellant experimented with in guns was called NOS-365 and was made up of hydroxyl ammonium nitrate, isopropyl ammonium nitrate and water. Theoretical calculations with NOS-365, showed that the impetus provided by the material was low. Impetus is the driving force supplied to the projectile and may be mathematically illustrated by the formula: $\text{Impetus} = nR\gamma T_o$ where n represents the moles of gas produced per unit mass of propellant, R is the gas constant and $\gamma T_o$ is the isochoric flame temperature.

One of the factors which receives major consideration in selecting a propellant for use in a liquid propellant gun is the flame temperature. Since repeated charges of propellant must be put in the firing chamber in rapid succession in a multishot weapon, it is desirable to have the flame temperature as low as possible to avoid overheating the chamber. Overheating of the firing chamber may lead to many problems. Among the more obvious problems are the possibility that the chamber walls may weaken and be ruptured and the possibility that when a "shot" of propellant is injected heat may cause it to ignite immediately rather than at the desired time. Moreover, throat erosion, which produces projectile inaccuracy, is aggravated by high flame temperatures.

Since n, R and $\gamma T_o$ are all multiplied to obtain the impetus, since R is constant and since $\gamma T_o$ should be relatively low to avoid the above mentioned heat problems, n must be high if one is to have a propellant that produces a high impetus and yet has a low isochoric flame temperature.

SUMMARY OF THE INVENTION

It has now been found that certain liquid ammonium perchlorate-ammonia compositions produce excellent impetus despite the fact that their isochoric flame temperatures are relatively low. Because of these properties and because these compositions meet other requirements necessary if a material is to be used as a liquid gun propellant, these compositions have been found to be highly desirable for use as liquid gun propellants.

DESCRIPTION OF THE PREFERRED EMBODIMENT

Ammonium perchlorate-ammonia solutions may be prepared by placing powdered ammonium perchlorate in a flask and adding liquid ammonia to the flask with stirring. It is preferable to use excess ammonia to hasten solution of ammonium perchlorate. Upon solution, excess ammonia may be removed by permitting it to boil off. A saturated solution at 15° C. contains about 75 weight percent ammonium perchlorate and about 25 weight percent ammonia.

Liquid ammonium perchlorate-ammonia solutions may also be prepared by placing ammonium perchlorate in a steel tank equipped with stirring means and adding liquid ammonia in the amount desired, i.e., without the above-mentioned boiling off step.

While a saturated solution contains about 75 weight percent ammonium perchlorate, solutions containing larger weight percentages of ammonium perchlorate can be prepared. For example, stoichiometric solutions which contain about 80 weight percent ammonium perchlorate and 20 weight percent ammonia can be prepared. However, when solutions which contain in excess of 75 weight percent ammonium perchlorate are stored, there is a danger that some ammonium perchlorate may precipitate out. Since it is desirable to fire a liquid propellant gun with a liquid rather than with a liquid-solid mixture, solutions containing more than 75 weight percent ammonium perchlorate are not as desirable for the purpose of this invention as are 75 weight percent ammonium perchlorate- 25 weight percent ammonia solutions. Besides presenting the danger of precipitation, such solutions have been found to give little benefit insofar as impetus is concerned and such solutions burn with an undesirably higher isochoric flame temperature than do 75 weight percent ammonium perchlorate-25 weight percent ammonia solutions (saturated solutions).

Saturated ammonium perchlorate-ammonium solutions and those that are less than saturated may be stored indefinitely without deterioration. They exhibit a vapor pressure of approximately 1 atmosphere at 20° C. and 50 psia at 165° F. and should be stored (74° F.) in a container capable of withstanding such pressure in order to conform to military specifications.

Saturated and less than saturated ammonium perchlorate-ammonia solutions may be readily metered from a storage container and delivered to the firing chamber of a liquid propellant gun by means of existing apparatus.

Saturated (75 wt. % $NH_4ClO_4$ 25 wt. % $NH_3$) and stoichiometric (80 wt. % $NH_4ClO_4$-20 wt. % $NH_3$) solutions were compared with 0.9 stoichiometric n-octane-$HNO_3$ (a composition containing enough n-octane to react with 90% of the $HNO_3$), with stoichiometric n-octane-$HNO_3$, with 1.1 stoichiometric n-octane-$HNO_3$, and with the monopropellant NOS-365. Chamber temperatures and impetus were compared. The following data resulted.

TABLE

| | Impetus (ft-lb/lb) | Chamber Temp. (°K.) |
|---|---|---|
| Satd. AP/$NH_3$ | 388,000 | 2340 |
| Stoich. AP/$NH_3$ | 397,000 | 2700 |
| 0.9 Stoich. O/F* n-octane-$HNO_3$, | 427,000 | 3320 |
| Stoich. O/F* n-octane-$HNO_3$ | 413,000 | 3300 |
| NOS-365 | 325,000 | 2180 |
| 1.1 Stoich. O/F* n-octane-$HNO_3$ | 396,000 | 3200 |

*O/F = oxidizer fuel.

It will be noted from the foregoing table that saturated ammonium perchlorate-ammonia produces up to a 10% lower impetus that the n-octane-nitric acid bipropellants. However, it also produces a substantially lower chamber temperature. While the chamber temperature produced by NOS-365 is somewhat lower than that produced by saturated ammonium perchlorate-ammonia, the impetus is also substantially lower.

If it is desired, water may be added to the saturated ammonium perchlorate-ammonia solution (or stoichiometric ammonium perchlorate-ammonia). Addition of 5 weight percent water to saturated AP/$NH_3$ solution decreases the impetus to about 364,000 ft-lb/lb and the chamber temperature to about 2180° K. Addition of 10 weight percent water reduces impetus to about 343,000 ft-lb/lb and chamber temperature to about 1900° K.

While saturated ammonium perchlorate-ammonia appears to approach optimum insofar as the relationship of concentration to impetus per degree of chamber temperature is concerned (note that the stoichiometric solution only gives an increase of 11,000 in impetus over that produced by the saturated solution while the chamber temperature increases by 270°), solutions containing less than 75 weight percent ammonium perchlorate may be used. As little as 65 weight percent ammonium perchlorate (and 35 weight percent ammonia) may be used.

What is claimed is:

1. A method for firing a liquid propellant gun comprising the steps of:

inserting a projectile into the rear of the gun barrel;

injecting a liquid monopropellant made up of ammonium perchlorate and ammonia into a chamber behind the projectile; and igniting the monopropellant.

2. A method according to claim 1 wherein said liquid monopropellant contains from about 65 to about 80 weight percent ammonium perchlorate and from about 35 to about 20 weight percent ammonia.

3. A method according to claim 2 wherein said liquid monopropellant contains about 75 weight percent ammonium perchlorate and about 25 weight percent ammonia.

* * * * *

UNITED STATES PATENT AND TRADEMARK OFFICE

CERTIFICATE OF CORRECTION

PATENT NO. : 5,060,551

DATED : October 29, 1991

INVENTOR(S) : Boggs, et. al.

It is certified that error appears in the above-identified patent and that said Letters Patent is hereby corrected as shown below:

On the title page, item [75] the fourth and last inventor has been left off.

Item [75] Inventors: Thomas L. Boggs, Jack L. Prentice, Donald E. Zurn; and Harold H. Bradley, Jr., all of Ridgecrest, California

Signed and Sealed this

Twenty-third Day of February, 1993

*Attest:*

STEPHEN G. KUNIN

*Attesting Officer*

*Acting Commissioner of Patents and Trademarks*